United States Patent [19]

Catalfamo

[11] 4,391,389

[45] Jul. 5, 1983

[54] ADJUSTIBLE ACTUATOR FOR PLURAL DISPENSING DEVICES

[76] Inventor: Giuseppe Catalfamo, Via Sanvito, 14, Varese, Italy

[21] Appl. No.: 245,392

[22] Filed: Mar. 19, 1981

[30] Foreign Application Priority Data

Apr. 8, 1980 [IT] Italy ..... 21240 A/80

[51] Int. Cl.[3] ..... B67D 5/52

[52] U.S. Cl. ..... 222/135; 222/282; 222/391

[58] Field of Search ..... 222/129, 134, 135, 137, 222/265, 275, 282, 309, 325, 326, 327, 391

[56] References Cited

U.S. PATENT DOCUMENTS 1,761,875 6/1930 Cordell et al. ..... 222/327

3,196,802 7/1965 Matheny ..... 222/325

*Primary Examiner*—David A. Scherbel

*Attorney, Agent, or Firm*—Kontler, Grimes & Battersby

[57] ABSTRACT

A device for dispensing two or more substances by pushing against the slidable bottoms of respective containers, includes an arrangement for varying the ratio at which the substances are being dispensed relative to one another.

18 Claims, 4 Drawing Figures

ADJUSTIBLE ACTUATOR FOR PLURAL DISPENSING DEVICES

BACKGROUND OF THE INVENTION

1. Field of the Invention

The present invention relates to dispensing devices in general.

More particularly, the invention relates to dispensing devices for dispensing two or more substances.

Specifically, the invention is directed to a device for dispensing two or more substances in different percentages.

2. The Prior Art

There are instances when it is desired for a dispenser to be capable of dispensing two or more substances (e.g. liquids, syrups, flowable powders or granules, pasty substances and the like) in certain ratios. A particular application is for dispensing of two-component compositions, for example, polyester and catalyst therefor which, when mixed in a certain ratio immediately prior to use, yield a composition used in the repair of automobile bodies. A prior art device for this purpose, the only one known to be on the market, has a base, a U-shaped pusher element with parallel legs the free ends of which push against the mobile bottom walls of two containers, and a system for advancing the pusher element towards the mobile bottom walls. These bottom walls are then each pushed towards stationary other bottom wall of the respective container, which results in the simultaneous expulsion of the two substances from the outlets of the two containers. The advancing system includes a movable rack for the pusher element and a pawl which cooperates with the rack and is operated by a lever driven by movement of a handle.

One of the most important disadvantages of this prior-art device is the fact that the ratio of one dispensed substance to the other (i.e. their percentages) is fixed and cannot be changed. Often, however, it is desired to be able to change this ratio; in fact, in many instances it is necessary to be able to do so to compensate for changes in ambient temperature and/or because of other reasons.

In the device known from the prior art, the operating lever must be moved by hand and its motion is transmitted to the movable bottom walls of the two containers. The volumetric content of the containers is therefore restricted to about 1.5 kg since the average human hand does not have sufficient strength to overcome the resistance offered by larger containers. Also, there is no way to continuously adjust the dispensing of the substances; the pusher system can move only in increments of one tooth of the rack. Accordingly, the quantity of the two substances being dispensed is always the same; it cannot be made smaller, nor can it be made larger than the predetermined amount except in whole multiples.

A further disadvantage of the prior-art device is that quite often at the beginning of the dispensing operation only one of the two substances will be discharged, and that the discharge of the other substance starts somewhat later. This changes the predetermined ratio of the two substances in the dispensed product. As a result, the product may have to be discarded. At the very least, that quantity of the sole substance which was dispensed before dispensing of the other substance began, has to be thrown away.

SUMMARY OF THE INVENTION

Accordingly, it is an object of the present invention to overcome the disadvantages of the prior art.

A more particular object of the invention is to provide an improved dispensing device which is not possessed of those disadvantages.

Still more specifically, it is an object of the invention to provide an improved dispensing device which enables a user to change the ratio of the dispensed substances.

A concomitant object of the invention is to provide a device of the type in question which assures that the dispensing of all products begins simultaneously.

An additional object is to permit the dispensing of continuously variable quantities of the substances, so that large, small or intermediate quantities of any desired magnitude may be selected for dispensing.

Yet a further object is to permit the use of substance containers of larger volumetric content than heretofore possible, by requiring the exercise of less strength on the part of a user.

In pursuance of the above objects, and of still others which will become apparent hereafter, one feature of the invention resides in a dispensing device which, briefly stated, may comprise first means for holding containers for at least two substances to be dispensed at a preselected ratio relative to one another, second means for effecting the dispensing of the substances, and third means connected with the second means and operative for changing the preselected ratio to a different ratio.

The novel features which are considered as characteristic of the invention are set forth in the appended claims. Both the construction and method of operation of the invention, as well as additional objects and advantages thereof, will however be best understood from the following description of specific embodiments in connection with the accompanying drawings.

DESCRIPTION OF PREFERRED EMBODIMENTS

Figure 1:
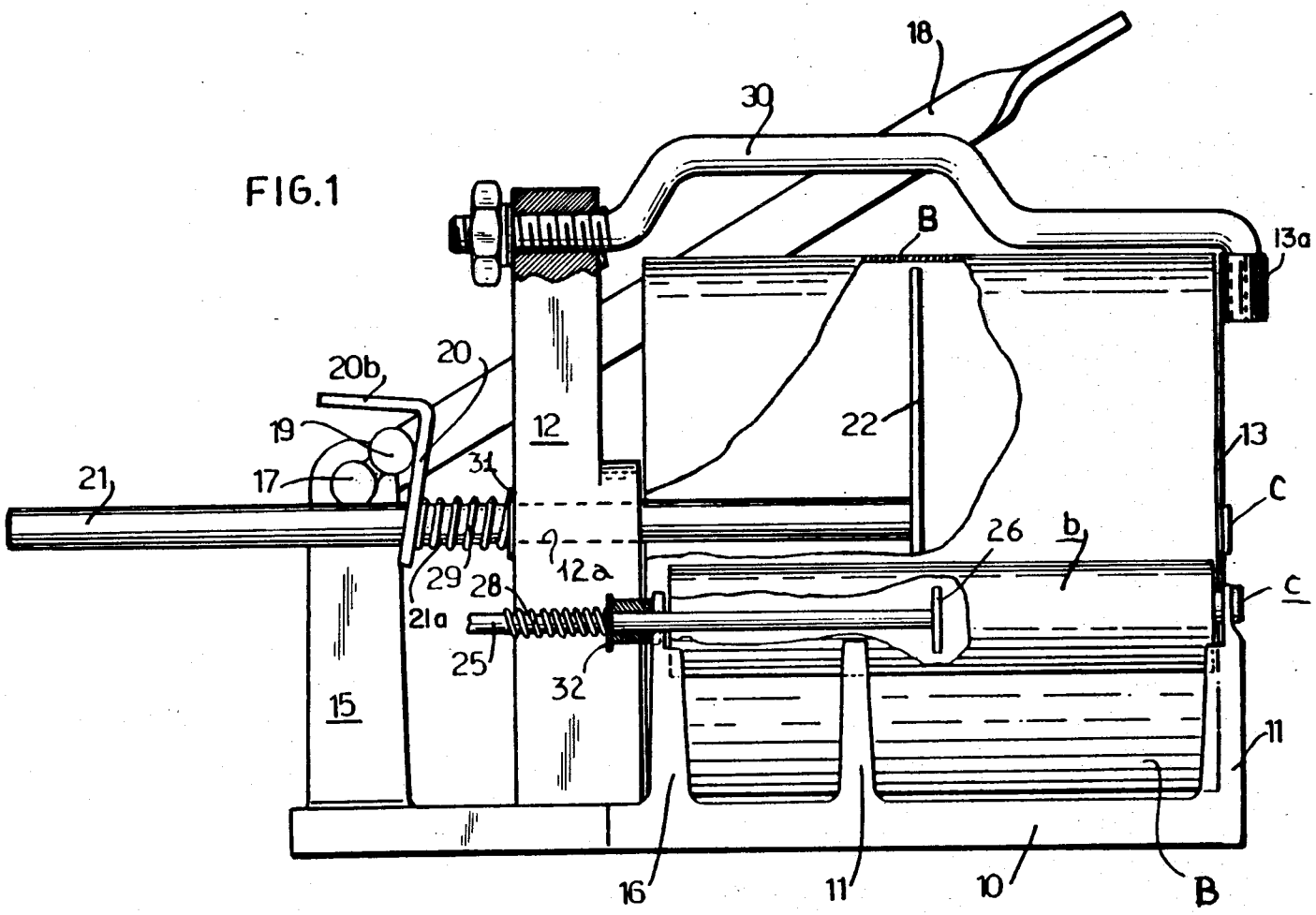
FIG. 1 is a somewhat diagrammatic view, partly in section, of one side of a device embodying the invention.

The drawing illustrates in FIGS. 1–4 an exemplary embodiment of the invention. Reference numeral 10 designates the base or frame of the inventive device. A larger container B having an outlet C rests on the base 10 and is held in place at one of its ends by an upstanding bearing element 12 and its other end by a plate 13. Laterally of the container B the base 10 has a plurality (here two) of upstanding cradles 11 which hold a smaller container b having outlet c. Plate 13 has an opening 14 through which the substances issuing from the outlets c, C of containers b, B may be dispensed or, as shown, outlet c may dispense laterally of opening 14. Other retainers, not shown, may be provided for the containers, if necessary. Depending upon the characteristics of the contents of the containers the outlets c, C may simply be permanently open (once the containers are installed) or conventional one-way outlet valves may control outflow through them in dependence upon pressure being exerted upon the container contents in manner still to be explained.

Bearing element 12 is mounted on the base 10 and is provided with an opening 12*a* oriented lengthwise of the base and of the containers. In addition, the base 10 mounts two further bearing elements 15 and 16. Element 15 has an opening 15*a* (FIG. 2) which extends normal to the opening 12*a* (cf. FIGS. 1 and 2) and the bearing element 16 has an opening 16*a* (FIG. 4) which extends parallel to the opening 12*a* but is laterally and vertically spaced therefrom.

Figure 2:
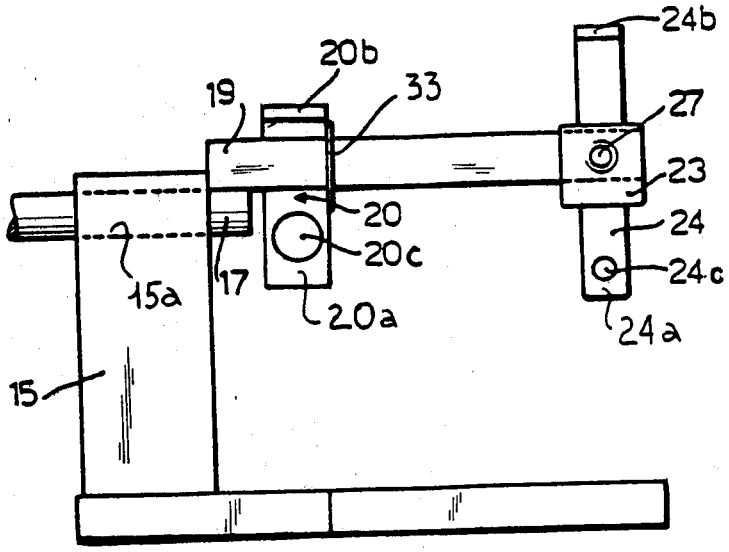
FIG. 2 is an end view of the device in FIG. 1, looking towards the right end with parts omitted for clarity.
Figure 3:
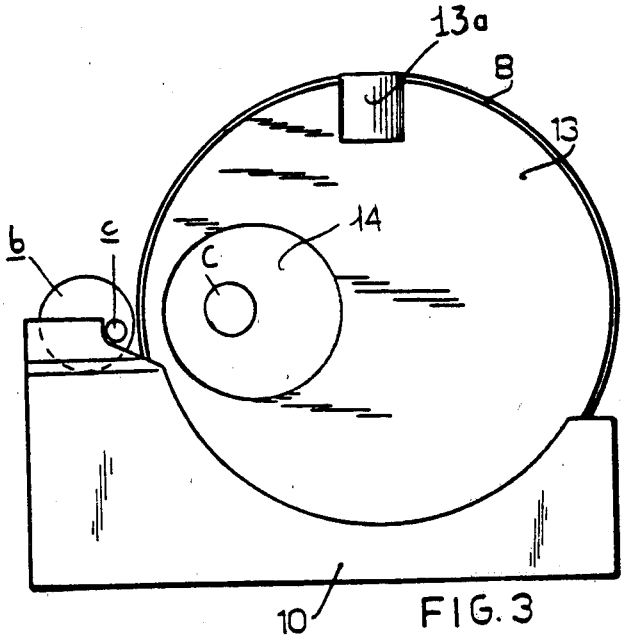
FIG. 3 is a front elevation of FIG. 1, looking towards the left and with parts omitted for clarity.
Figure 4:
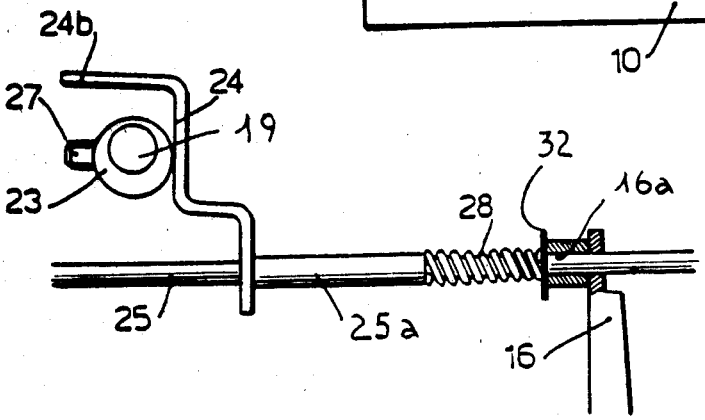
FIG. 4 shows a detail of FIG. 1, partly in section.

A shaft 17 is turnably received in the opening 15*a* and is provided with an eccentric shaft section 19 (see FIG. 2). A push rod 21 extends through the opening 12*a* and carries at its leading end a disk 22 which pushes against the left-hand movable end-wall (not shown) of the container B; it is known to make such end-walls slidable lengthwise within their container but to have them engage the inner periphery of the container in a sealing manner. Thus, as disk 22 pushes the endwall towards the right, some of the content is expelled from the container B. A similar push rod 25 is slidably received in the opening 16*a* of bearing element 16 and carries at its leading end a smaller disk 26 which acts in similar manner upon the (not illustrated) slidable left endwall of container b.

A member 20 of flat sheet metal, such as iron, is of preferably L-shaped configuration and has an upright portion 20*a* provided with a hole 20*c* (FIG. 2) and an upper generally horizontal portion 20*b*. Push rod 21 extends through the hole 20*c* and the portion 21*a* is located to the right (FIG. 1) of eccentric section 19. A helical expansion spring 29 surrounds the rod 21 and is stressed between the portion 20*a* and the bearing element 12. Since hole 20*c* is in the lower part of portion 20*a*, the spring 29 holds the member 20 on the rod 21 in the position illustrated in FIG. 1, which is to say that the rod is arrested by the member 20 against longitudinal movement but can be released by pressing down upon the free end of portion 20*b*, until the portion 20*a* assumes a vertical position as the member 20 is fulcrumed about its line of contact with the eccentric 19. When shaft 19 turns in response to displacement of lever 18, the eccentric shaft section 19 pushes the upright portion of member 20 and this causes forward movement (to the right in FIG. 1) of push rod 21 and the feed of substance from container B.

The end of eccentric shaft section 19 which is remote from the member 15 carries an adjustable eccentric 23. This operates the feed of substance from the container b in the same manner as described with reference to the operation of shaft section 19. Eccentric 23 cooperates with a member of flat bar material 24 of iron or the like, having a hole 24*a* through which the push rod 25 extends. Member 24 is biased (here via an interposed sleeve 25*a*) by a helical spring 28 surrounding the push rod 25, again in the same manner as discussed before, the member 24 is advantageously also of L-shaped configuration for the reasons explained earlier (i.e. because this makes it easier to operate for releasing rod 25). To avoid clutter this system has not been illustrated in FIG. 1. The position of eccentric 23 relative to shaft section 19 may be varied by releasing the set screw 27, turning eccentric 23 to the desired position and re-tightening the set screw. This permits an adjustment of the contact line between the eccentric and the member 24 to be made, as desired, so that the feed (the amount of lengthwise movement) of rod 25 will be changed accordingly.

A lever 18 is non-rotatably secured to the shaft section 19 (FIG. 2) and a handle 30 is connected to the bearing element 12 and the plate 13 at journal box 13*a* to fix the container B in place. Handle 30 is preferably secured to element 12 by means of a nut-and-thread connection, as shown in FIG. 1, so that it can be adjusted as may be required. The handle 30 can, of course, also be used to carry the device from one location to another.

Two seeger rings 31 and 32 are mounted by a force fit on the push rods 21 and 25, respectively, to prevent backwards movement (left in FIG. 1) of these rods when lever 18 performs its load-free return stroke during which the upright portions of members 20 and 24 release the push rods. The elastic deformation of the rings 31, 32 acts to restrain backward movement of the rods 21, 25. A further seeger ring 33 is mounted on eccentric shaft section 19 to avoid sideways movement of the element 20.

The operation of the device is as follows.

To install the containers b, B the operator removes handle 30 and plate 13 and depresses the portions 20*b*, 24*b* of the members 20, 24. This releases the push rods 21, 25 so the operator can withdraw them all the way (to the left in FIG. 1). After the containers are put in place the operator reassembles the plate 13 and the handle 30 and pushes the rods 21, 25 forward (to the right in FIG. 1) until their disks 22, 26 engage the movable endwalls of the respective containers. Movement in this direction, incidentally, can be effected without th need to depress the portions 20*b*, 24*b*. The operator then opens the outlets c, C which thereafter remain open (unless controlled by one-way valves).

When the disks 22, 26 are in engagement with the movable end walls of the respective containers, the operator ceases to push the rods 21, 25. Instead, he now pulls down the free end of lever 18. This causes rods 21, 25 to begin moving forwards again but the contents of the two containers will not begin to be expelled at one and the same time. Accordingly, as soon as the operator notices that contents begin to emerge from one of the containers, he ceases pulling on the lever 18. Then he depresses portion 24*b* (if the contents already emerging are those of container b) or else the portion 20*b* (if the contents already emerging are those of container B) and pulls again on lever 18 to cause rod 21 or 25 to move forwards until the contents of the other container also begin to emerge. If necessary, the two operations may be alternated until the contents of both containers are ready to be discharged simultaneously. The operator then releases the portion 24*b* and/or 20*b* and resumes pulling on the lever 18. The contents of the two containers will now be dispensed in the desired percentage ratio.

When and if it is subsequently desired to change the percentage ratio of the two products being dispensed from the containers b, B, it is sufficient to adjust the angular position of the eccentric 23 by turning the same on the shaft section 19. This will cause a smaller or greater advancement of rod 25 with reference to rod 21 and thereby change the dispensing ratio.

When container B is almost empty the disk 22 (and hence the movable end wall of the container B) will be almost in contact with the plate 13. Thus, buckling of the other (fixed) container end wall is precluded and in consequence no waste of the container contents can take place.

The invention is susceptible to a variety of changes and modifications, all of which are intended to be encompassed within the ambit of the appended claims. For example, it is evidently possible to utilize more than two containers and to dispense more than two products. The length of the lever arm of lever 18 may be chosen as is most convenient for operation, i.e. to require the operator to exert minimum strength. The members 20, 24 could have a shape different from that illustrated; also, the seeger rings 31, 32 could be replaced with elements similar to the members 20, 24. The axes of the openings for the push rods need not, as illustrated, be normal to the axes of the opening for the shaft 17, although this is currently preferred.

While the invention has hereinbefore been discussed with reference to a single embodiment, it is understood that all modifications and changes including those mentioned immediately preceding, are intended to be encompassed by the appended claims.

I claim:

1. In a dispensing device, a combination comprising:

first means for holding containers for at least two substances to be dispensed at a preselected ratio to one another, said containers each being of the type having one end provided with a stationary end wall and a second end provided with a movable end wall which is slidable toward said one end to effect expulsion of the substance of the container;

second means for effecting the dispensing of said substances, said second means comprising a plurality of linearly movable pusher members, one for each container, each pusher member having a leading end portion adapted to press against and effect movement of one of said movable end walls and further comprising for each of said pusher members an element of rigid strip material having a hole through which the respective pusher member extends, an abutment portion engaging said element spaced from and at one axial side of the pusher member, a spring engaging the element adjacent said pusher member at the opposite axial side and urging the element towards said one side so that the element tilts on the pusher member and the edge portions bounding said hole entrainingly engage the pusher member; and third means connected with said second means and operative for changing said preselected ratio to a different ratio.

2. A combination as defined in claim 1, wherein said second means further comprises adjustable eccentric means operatively connected with one of said pusher members for imparting to said one pusher member a linear movement, the length of which differs from and is adjustable with reference to the length of the linear movement of another of said pusher member.

3. A combination as defined in claim 2, said second means further comprising pivotable lever means, including a lever having a lever arm of desired length, operatively connected with said pusher members to effect linear displacement thereof.

4. A combination as defined in claim 2, and further comprising means for constraining said pusher members for movement in one direction.

5. A combination as defined in claim 4, said constraining means being a Seeger ring on the respective pusher member.

6. A combination as defined in claim 4, said constraining means being a bar-element having a hole through which the respective pusher element extends, and a spring biasing the bar element to an inclined position in which edge portions bounding said hole engage a surface of the respective pusher element.

7. A combination as defined in claim 1, each of said elements being substantially L-shaped and having one part provided with said hole and another part extending substantially normal to said one part and adapted to be pressed by a user towards the respective pusher member to move said edge portions out of engagement with the pusher member and release the pusher member for movement.

8. A combination as defined in claim 1, the containers each being of the type having one end provided with a stationary end wall and an opposite end provided with a movable end wall which is slidable towards said stationary end wall; said first means comprising a frame adapted to support the containers and at least one plate on said frame and engageable with the stationary end walls over substantially the entire surface area thereof so as to support the stationary end walls against bulging in response to the approach of the respective movable end wall.

9. A combination as defined in claim 1, said first means including a frame, and a handle on said frame.

10. A combination as defined in claim 9, said frame having an upstanding plate and, spaced therefrom, an upstanding member, said containers being adapted to be confined between said upstanding plate and member and including at least one larger and at least one smaller container; and said handle being connected to said upstanding plate and member.

11. A combination as defined in claim 10, and further comprising adjustable mounting means for said handle.

12. A combination as defined in claim 1, said second means including push rods for expelling the container contents, a shaft mounting an operating lever for said push rods, and bearings for said push rods and shaft, the bearing for said shaft having an axis which extends normal to the axes of the bearings for the push rods.

13. Apparatus adapted to dispense in variable percentages at least two substances contained in at least two containers, said apparatus comprising:

a plurality of containers each including a substance to be dispensed, each of said containers having at least one fixed wall and at least one movable wall;

a base including a plurality of upstanding cradles for supporting said containers;

means for advancing said movable walls of said containers to dispense the substances from each of said containers, said means including for each of containers:

a movable push rod having at the leading end thereof a dispensing disc, each of said rods being adapted to be linearly advanced toward said at least one movable wall of the container, means for advancing each of said push rods, and means for arresting backward movement of each of said push rods, wherein said means for advancing said push rods comprises:

at least one shaft for each rod, each of said shafts including at least one eccentric connected thereto, said at least one eccentric being so configured that their angular position relative to its geometrical axis of rotation is adjustable to permit independent advancement of each push rod so as to control the ratios of the substances being dispensed from each container, at least one member which cooperates with said eccentric and includes a hole therethrough through which the push rod extends, at least one spring pressing on one end against an element secured to the base and on the opposite end against said member in an opposite direction relative to the advancement of said push rods in order to hold the member in a constantly inclined and engaged position on one side by means of the hole and on the other side by means of the eccentric, and control means comprising a lever non-rotatably secured at one end to said shaft and adapted to exert continuous pressure on said shaft, wherein said means for arresting comprises a seeger ring about said push rod and inclined in an opposite direction relative to said advancement of said rod and at least one spring so as to always be engaged with the push rod to exert a continuous arresting action against backward movement of said push rod.

14. The apparatus as defined in claim 13, wherein the inclined members extend beyond the line of contact with the eccentrics enabling them to operate as a lever to disengage them from the push rods and further allowing them to be released and move freely in the formerly blocked direction.

15. The apparatus as defined in claim 14, wherein the pusher members are L-shaped to facilitate disengagement with the rods.

16. The apparatus as defined in claim 13, wherein the base further includes a plate adopted to engage the containers over their entire bottom surface and to prevent the containers from bulging.

17. The apparatus as defined in claim 16, wherein said base further includes a bearing element and a handle connected at one end thereof to said bearing element and at the other end thereof to said plate to permit said apparatus to be carried.

18. The apparatus as defined in claim 17, wherein said handle is adjustable.

* * * * *